United States Patent [19]

della Porta

[11] Patent Number: 4,486,686

[45] Date of Patent: Dec. 4, 1984

[54] GETTER ASSEMBLY WITH U-SHAPED SUPPORTS

[75] Inventor: Paolo della Porta, Milan, Italy

[73] Assignee: S.A.E.S. Getters S.p.A., Italy

[21] Appl. No.: 377,462

[22] Filed: May 12, 1982

[30] Foreign Application Priority Data

May 20, 1981 [IT] Italy ..... 21852 A/81

[51] Int. Cl.[3] ..... H01J 29/94

[52] U.S. Cl. ..... 313/481

[58] Field of Search ..... 313/481, 553, 558, 559, 313/560, 561

[56] References Cited

U.S. PATENT DOCUMENTS 3,508,105 4/1970 Pappadis ..... 313/481

3,558,961 1/1971 Palsha ..... 313/481

*Primary Examiner*—Palmer Demeo

*Assistant Examiner*—Sandra L. O'Shea

*Attorney, Agent, or Firm*—David R. Murphy

[57] ABSTRACT

A getter assembly is provided with a tab and a support means adapted for contacting the wall of an electron tube, preferably a television picture tube, the support means is in the form of a metal strip, integral with the getter assembly, bent into a U-shape and terminating at each end with a rounded support foot.

6 Claims, 4 Drawing Figures

GETTER ASSEMBLY WITH U-SHAPED SUPPORTS

BACKGROUND OF THE INVENTION

Figure 1:
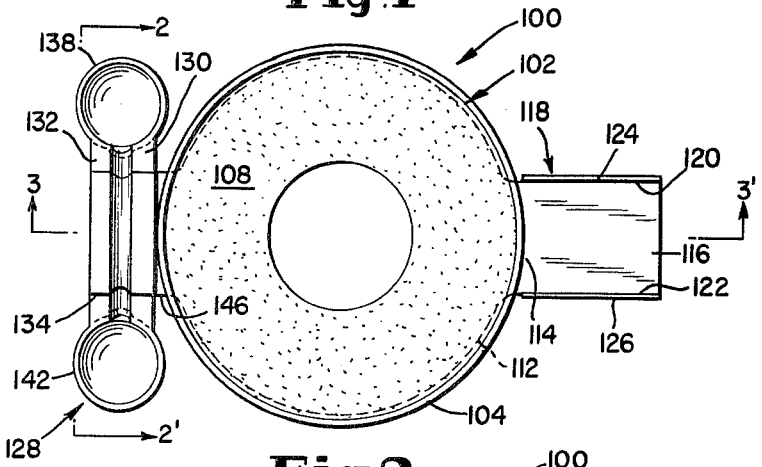

The use of the getter materials in the manufacture of electronic tubes is well known. A commonly used getter assembly consists of a U-shaped channel getter material container in annular form with a getter material contained within the channel. This assembly is mounted within an electron tube, for example, a color television picture tube. After the tube is evacuated, the residual gases left in the tube are reroved by heating the getter assembly and getter material contained therein to a high temperature, suitably by induction heating, whereupon the getter material is flashed or vaporized. The vaporized getter material absorbs or reacts with the residual gases and removes them as low vapor pressure solid condensates and continues to absorb any further liberated gases throughout the life of the tube.

Usually the getter material principally comprises: a mixture or preferably an alloy of metals such as, for example, barium and aluminium. It is the barium component of this alloy which provides the reactive material. The clean up of residual gases in television picture tubes, and particularly color tubes, requires a relatively large amount of active barium material. For example, a 25 inch screen color tube having three electron guns and a metal shadow mask has been found to require a yield of 175 to 225 mg of barium. Since the barium-aluminium alloy might have contained up to about 50 percent aluminium, the total amount of alloy in the container before flashing could be from 350 to 450 mg. It has further been found desirable to employ exothermic gettering powders in color television picture tubes. An exothermic gettering powder can comprise: a barium-aluminium alloy or mixture plus about an equal weight of powdered nickel. The nickel reacts exothermically with the aluminium upon heating to supply additional heat for evaporating the barium. The self-generated heat lessens the getter flasking time from 30 seconds for an endothermic type getter to 15 or 20 seconds witn the exothermic type getter.

A typical channel ring exothenaic getter assembly used in color television picture tubes thus may contain, for example, 1000 mg of a 25 weight percent barium-25 weight percent aluminium-50 weight percent nickel exothermic alloy yielding about 200 mg of barium on heating. The getter container itself may comprise a U-shaped channel formed into a ring of, for example, about 2.54 cm outside diameter and having a channel width of 0.5 cm Alternatively, the outer diameter may be about 1.5 or 2 cm and the channel width may be about 0.5 cm. Tne getter powder is pressed into the channel. The flashing of the getter requires heating to a high temperature, about 1300° C., to vaporize the barum, or whatever getter material is utilized. As a result of this heating the residue and the channel ring container are themselves heated to a high temperature. This heating results in the melting or sintering of the residue, eitner the aluminium powder in an exothermic getter, the barium-nickel-aluminium powder in the case of the exothermic alloy described above, or whatever unflashed material is present. The container itself, generally stainless steel, is itself heated to a temperature often near its melting point, and in the case of improperly formed or positioned getter assemblies, the stainless steel ring may melt.

The presence of the extremely hot getter container in a glass-walled electron tube can cause serious problems as will be seen from the following: an electron tube, particularly a television picture tube generally comprises a neck portion in which are located the electron gun or guns and auxiliary equipment; an enlarged bulb portion which terminates in a generally flat viewing screen; and a funnel-shaped portion joining the neck and bulb portions. Whereas in the past, the ring shaped getter container was usually mounted in the neck portion of the tube positioned on the electron gun, it is now a desired practice to mount the getter container in or near the funnel portion of the tube. Since the getter container must be outside the path of the stream of electrons directed from the electron gun toward the screen and since the diameter of the funnel cross-section at the selected site may be only slightly larger than that of the neck portion, it is necessary to have the getter container actually abutting against the wall of the tube. This is accomplished by mounting the getter container at the end of a spring-like metallic strip support or "antenna", the other end of which is fixed to a wall of the electron gun in tne neck portion of the tube. The spring is biased to force the getter container against the wall of the tube in the funnel portion and thus keep clear the path for the electron beam.

Another widely used getter device mounting position is in the region of the anode button. Usually the getter assembly is attached to a small leaf spring. The leaf spring is then attached by suitable means to the anode button, the resilience of the spring forcing the getter assembly against the wall of the tube.

This positioning of the getter assembly in direct contact with the glass walls of the tube can and often does cause cracking of the glass when the getter assembly is heated inductively to high temperatures during flashing. Since the television tube is for the most part completely fabricated just prior to gettering, the cracking of the tube at this time is a substantial loss. In addition, it is important that the getter assembly be properly aligned inside the tube so that the gettering flash is properly directed. Such alignment is difficult to achieve using normal production line techniques. Even if the getter assembly is distanced from the wall by wire runners, for instance, the high temperatures encountered during flashing can cause the support spring or other metallic parts to soften causing the getter device to change its orientation relative to the induction coil thus provoking all the inconveniences described in U.S. Pat. No. 3,558,961.

Getter assemblies having high barium yields and providing protection against thermal breakage of television picture tubes have been described in U.S. Pat. No. 3,390,758 assigned to Union Carbide Corporation and U.S. Pat. No. 3,381,805 assigned to SAES GETTERS S.p.A. The means of protection against thermal breakage of the television picture tube or kinescope was by means of the provision on the getter device of a ceramic support material having a low thermal conductivity and being opague to thermal radiation.

Unfortunately, these assemblies even when having a central core opening are very heavy and in consequence the spring or "antenna" which is used to hold the getter device in position on the wall of the kinescope has to be heavily biased tensioned. This is to prevent the excessive vibration of the kinescope that occurs, for example, during transport which causes the getter assembly to momentarily detach itself from the kinescope wall and on being constrained to go to its original position causes such a sharp impact as to damage the kinescope walls or its internal coatings.

A heavy antenna biasing can, for instance, also react upon the electron beam gun structure causing it to be deviated or misaligned from its intended position.

It is therefore an object of the present invention to provide a getter assembly free from one or more of tne disadvantages of prior getter assemblies.

Another object of the present invention is to provide an improved support means for a getter assembly which does not provoke cracking of glass walls with which it is in contact.

A further object of the present invention is to provide an improved getter assembly support means which does not cause the getter assembly to change its orientation during flashing.

These and other objects and advantages of the present invention will become apparent with reference to the following description whereof and drawings wherein:

FIG. 1 is a top view of a getter assembly of the present invention.

Figure 2:
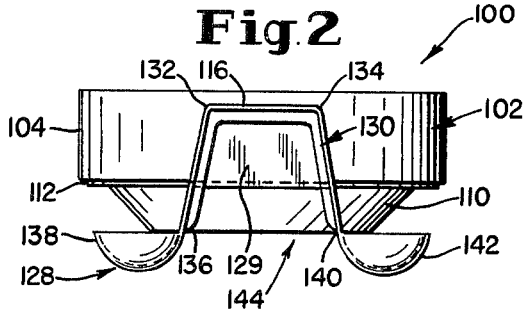
Figure 3:
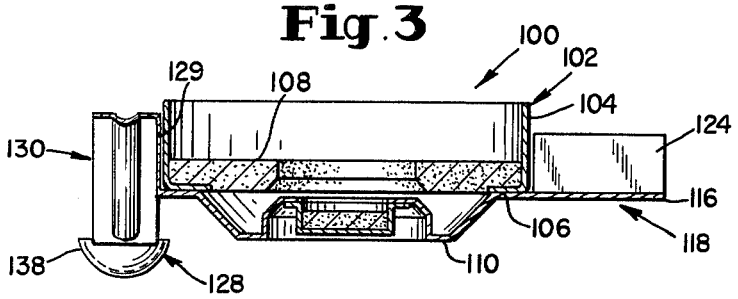

FIG. 2 and 3 are cross-sectional views taken along lines 2—2' and 3—3'. respectively of FIG. 1.

Figure 4:
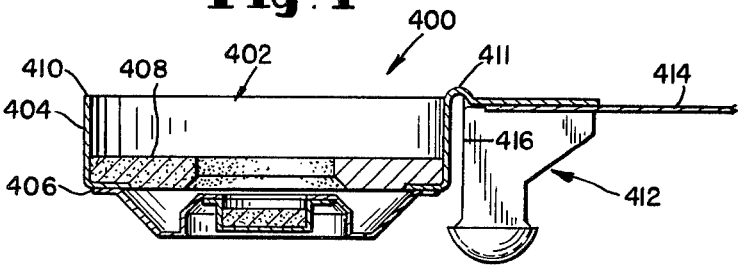

FIG. 4 is a cross-sectional view of an alternative getter assembly of the present invention.

The present invention provides an improved getter assembly for mounting in an electron tube and more specifically a television picture tube The getter assembly comprises a holder having an outer wall and a bottom wall supporting an evaporable getter metal vapour releasing material. The term "getter metal vapour releasing material" as used in the specification and claims herein is meant to include both the material prior to and after getter metal vapour release. This term embraces both the material in the form sold with the getter assembly and in the form in which it is found in an operating tube wherein the bulk of the getter metal has been evaporated from the material and is in the form of a film on the inside surfaces of the tube.

The getter assembly also comprises a tab and a support means adapted for contacting a wall of the electron tube. The support means is integrally formed with the getter assembly and comprises a metallic strip having a length greater than its width. The strip is bent into a 'U' shape along at least one line perpendicular to the length of the strip. At each end of the strip length the terminal portion is formed into a rounded support foot.

Referring now to the drawings and in particular to FIGS. 1 to 3 there is shown a getter assembly 100 comprising a holder 102 having an outer wall 104 and a bottom wall 106. Holder 102 supports a mass 108 of compressed powdered barium aluminium alloy in admixture with powdered nickel. A substantially disc shaped reflecting element 110 is attached to bottom wall 106 of holder 102. Outer edge 112 of reflecting element 110 is integrally attached to one edge 114. of a quadrilateral element 116 of a tab member 118. The two edges 120, 122 of the quadrilateral element 116 adjacent to said one edge 114 integrally support each respectively a first and second reinforcing element 124, 126 so forming sidewall members 124, 126. The sidewall members 124, 126 are in perpendicular relationship with quadrilateral element 116 and are in abutting relationship with outer wall 104 of the holder 102. The tab member 118 has a 'U' shaped cross section the open portion of which faces away from the bottom wall 106 of holder 102.

Diametrically opposite said tab member 118 is located a support member 128 which comprises a metallic strip 130 having a length greater than its width. Strip 130 is integrally attached to outer edge 112 of reflecting element 110 by means of a bridging element 129. Strip 130 is bent along lines 132 and 134 perpendicular to the length of the strip 130 thus forming a 'U' shape. The strip 130 tenminates at one end 136 with a first rounded support foot 138 and at the other end 140 with a second rounded support foot 142. The open portion 144 of 'U' shaped support member 128 faces towards the bottom wall 106 of holder 102. One edge 146 of 'U' shaped support member 128 is in contact with outer wall 104.

Referring now to FIG. 4 there is shown an alternative getter assembly 400 of the present invention comprising a holder 402 having an outer wall 404 and a bottom wall 406. Holder 402 supports an evaporable getter metal vapour releasing material 408. Upper edge 410 of outer wall 404 is integrally attached by means of a bridging element 411 to a support member 412 identical to support member 128 shown in FIGS. 1 to 3. Also shown is an antenna spring 414 attached to the support member 412 which in this case also functions as a tab with which it is integrally formed. One edge 416 of the support member tab 414 is in abutting relationship with outer wall 404.

In use, the getter assembly will be mounted in such a position that the forces acting on the assembly are such as to encourage the maintainance of the abutting relationship between the support member and tab with the outer wall of the getter holder.

It has been found in practice that when the getter assembly is heated by induction heating to cause evaporation of the getter metal that, even when the temperature of the holder goes above 1000° C., the temperature of the support feet only reach a temperature of about 450° C., a temperature sufficiently low to avoid breaking the glass upon which it is resting.

Although the invention has been described in considerable detail with reference to certain preferred embodiments thereof, it will be understood that variations and modifications can be effected within the spirit and scope of the invention as described above and as defined in the appended claims.

What is claimed is:

1. A getter assembly having an improved support for mounting in an electron tube comprising a holder having an outer wall and a bottom wall supporting an evaporable getter metal vapour releasing material, a tab, and a support means, adapted for contacting a wall of the electron tube integrally formed with said assembly support means comprising a metallic strip bent into a U shape, said strip having a length greater than its width, the bend taking place along at least one line perpendicular to the strip length, the strip terminating at each end with a rounded support foot.

2. A getter assembly of claim 1 in which one edge of the 'U' shaped strip is in contact with the outer wall of the holder.

3. A getter assembly of claim 1 in which the support means is integrally formed with the tab.

4. A getter assembly of claim 1 in which the support means is attached to the assembly in a position diametrically opposite to the tab.

5. A getter assembly according to any of the preceding claims in which the support means is integrally connected to the getter assembly by means of a bridging element.

6. A getter assembly having an improved support for mounting in a television picture tube comprising:

(A) a holder having an outer wall and a bottom wall supporting a compressed powdered barium aluminium alloy in admixture with powdered nickel; and (B) a substantially disc shaped reflecting element attached to the bottom wall of the holder wherein the outer edge of the reflecting element is integrally attached to:

(i) one edge of a quadrilateral element of a tab member, the two edges of the quadrilateral element adjacent to said one edge integrally supporting each respectively a first and second reinforcing element so forming sidewall members in perpendicular relationship to the quadrilateral element and in abutting relationship with the outer wall of the holder; the tab member being U-shaped, the open portion of which faces away from the bottom wall of the holder; and (ii) a support member diametrically opposite said tab member wherein said support member comprises a metallic strip having a length greater than its width bent into a U-shape, the bend taking place along at least one line perpendicular to the strip length; the strip terminating at each end with a rounded support foot, the open portion of which faces towards the bottom wall of the holder and one edge of the U-shape is in contact with the outer wall of the holder.

* * * * *